United States Patent [19]

Webb

[11] Patent Number: 4,775,073

[45] Date of Patent: Oct. 4, 1988

[54] MULTI-PURPOSE FITTING SYSTEM

[75] Inventor: Michael C. Webb, Exton, Pa.

[73] Assignee: Total Containment, Exton, Pa.

[21] Appl. No.: 103,205

[22] Filed: Oct. 1, 1987

[51] Int. Cl.[4] ..... B65D 51/16; B65D 51/18

[52] U.S. Cl. ..... 220/256; 220/288; 220/465

[58] Field of Search ..... 220/256, 258, 465

[56] References Cited

U.S. PATENT DOCUMENTS 4,625,889 12/1986 Baughman ..... 220/288
4,706,836 11/1987 Greck ..... 220/256
4,708,260 11/1987 Siegal et al. ..... 220/256

*Primary Examiner*—George T. Hall
*Attorney, Agent, or Firm*—Larson and Taylor

[57] ABSTRACT

A multi-purpose fitting system includes a container having an inner tank and an outer tank made of a plastic material. An aperture is provided at the top of the container in which a multi-purpose fitting is provided. The fitting includes a close-off fitting base having a flange which is permanently attached to an outer surface of the inner tank. A close-off skirt made of a plastics material rest on the flange and extends beyond the flange to additionally rest on the outer tank. This skirt is securely attached to an outer surface of the outer tank such as by a continuous weld which provides a seal between the skirt and outer tank. A close-off ring is threadably received on a threaded upper portion of the close-off fitting base to press the skirt against the flange. A fitting member is threadably received in an interior threaded aperture of the close-off fitting base as appropriate. A close-off cap preferably covers the close-off ring, and a suitable seal is provided between the close-off cap and the close-off skirt. The skirt also preferably includes a raised circumferential rib positioned so that the close-off cap has a depending rib which fits snuggly between the close-off ring and the raised rib. The closed-off cap is also preferably designed to be cut at stepped rings thereof to form an opening concentric with the interior threaded aperture such that a fitting member including a pipe passes through the opening and is sealed by wrap-around heat shrink plastic member. The fitting member can also preferably be a hook portion by which the container may be lifted.

13 Claims, 3 Drawing Sheets

MULTI-PURPOSE FITTING SYSTEM

FIELD OF THE INVENTION

The present invention relates generally to a fitting for a container or the like, and more particularly to a multi-purpose fitting system which is adaptable for different purposes.

BACKGROUND OF THE INVENTION

In an effort to reduce the cost of large containers for liquids, such as petrochemicals or the like, a factory fabrication is desired. However, the size of such containers is frequently a problem in transporting such containers by roads. In addition, depending upon the particular application of the container, it is necessary to provide appropriate fittings at appropriate locations. Thus, even if factory made, each container must be customized to have the appropriate fittings.

The providing of appropriate fittings is also a problem where the container typically includes an inner tank made of metal and an outer tank made of a suitable plastics material. With such a container construction, the continued protection of the inner container from the outside environment by a plastic covering is desirably maintained at the fittings as well. This requires that particular fittings be dedicated to particular uses using predetermined elements.

SUMMARY OF THE INVENTION

In accordance with the present invention, a multi-purpose fitting system is provided whereby a number of different uses are possible at a single fitting. The container for the fitting system includes an inner tank, typically made of metal, and an outer tank surrounding the inner tank and made of a plastic material such as a high density polyethylene. An aperture at the top of the container is provided through the inner tank and outer tank. A multi-purpose fitting is provided for the container aperture and includes a closed-off fitting base having an interior threaded aperture, an exterior threaded upper portion, and a flange located below the exterior threaded upper portion. The flange is permanently attached to an outer surface of the inner tank by an attaching means such that the exterior threaded upper portions extends above the outer tank. The attaching means also provides a seal between the flange and the outer surface of the tank. A closed-off skirt made of a plastics material rests on the flange and extends beyond the flange to additionally rest on the outer tank. A skirt attaching means is provided for attaching the skirt securely to an outer surface of the outer tank and for providing a seal between the skirt and the outer surface of the outer tank. A close-off ring is threadably received on the threaded upper portion of the closed-off fitting base in order to press the skirt securely against the flange. Finally, a suitable fitting member is threadably received n the interior threaded portion of the closed-off fitting base.

In a preferred embodiment, a holding means is provided for increasing the frictional holding between the closed-off ring and the closed-off skirt. A suitable holding means is an O-ring disposed between the skirt and the flange.

In the preferred embodiment, a close-off cap covering the close off ring is also provided. In addition, a cap sealing means provides the seal between the close-off cap and the close-off skirt. The skirt preferably includes a raised circumferential rib about and adjacent the close-off ring. The close-off cap then includes a depending rim which fits snuggly between the close-off ring and the raised rib. The cap sealing means is then preferably a weld between the rib of the close-off skirt and the rim of the close-off cap. Similarly, the skirt attaching means is preferably a weld between the skirt and the outer tank and the flange attaching means is a weld between the flange and inner tank.

In one embodiment of the present invention, the fitting member is a plug. This plug serves to close the fitting system until and if access is needed. Thus, the plug can be removed at the time of insulation, or at some later date when access become necessary.

The close-off cap is also preferably formed of a plurality of stepped rings. Then, when access is desired to the container, the closed-off cap is designed to be cut at one of these stepped rings to form an opening concentric with the interior threaded aperture of the close-off fitting base. With such a construction, the fitting member includes a pipe extending through the opening and closely adjacent the cap. Where such a pipe is used, a pipe sealing means is also preferably provided in order to form a seal between the pipe and cap. A suitable sealing means is a wrap-around heat shrink plastic member.

The fitting member can also be a hook portion by which the container is lifted into place. Subsequently, the hook portion can be removed and another fitting member used in place of the hook portion as necessary.

In the preferred embodiment, a stand-off mesh is also provided between the inner tank and outer tank. In addition, a drain port is optionally provided between the cap sealing means and the close-off ring.

It is an object of the present invention to provide a multi-purpose fitting system which is installed in a container at a factory site. This fitting system is then suitable for different usages, depending upon the needs of the user at the installation site.

It is also an object of the presnnt invention to provide a multi-purpose fitting system for a container including an outer tank made of a plastic material in which the fitting also includes a plastic covering.

Other features and objects of the present invention are stated in or apparent from a detailed description of the presently preferred embodiments of the invention found hereinbelow.

DETAILED DESCRIPTION OF THE PREFERRED EMBODIMENTS

Figure 1:
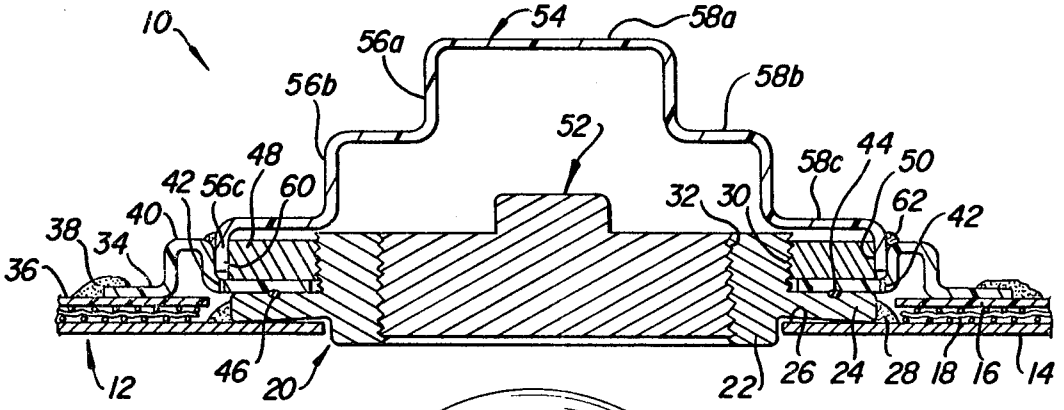
FIG. 1 is a cross-sectional elevation view of the multi-purpose fitting system of the present invention.

With reference now to the drawings in which like numerals represent like elements throughout the several views, a multi-purpose fitting system 10 according to the present invention is depicted in FIG. 1. Multi-purpose fitting system 10 includes a container 12, of which only a small portion thereof is shown. Container 12 is of the type having an inner tank 14 made of a suitable material for the liquid to be contained (typically the material is a metal such as stainless steel), and an outer tank 16 surrounding inner tank 14 made of a suitable plastics material such as a high density polyethylene. Provided between inner tank 14 and outer tank 16 is a stand-off mesh 18. Containers 12 of this type are described in U.S. Pat. Nos. 4,568,925 (Butts) and 4,672,366 (Butts), which references are herein incorporated by reference. Containers 12 of this type are typically used for underground storage of fuels or other petrochemicals. For this reason, care must be taken to make sure that no leakage occurs from container 12. Thus, where access is desired to container 12, particularly at the top of container 12, care must be taken to make sure that no leakage occurs at this point.

As shown in FIG. 1, container 12 includes an aperture 20 at the top thereof which is designed to allow access to container 12. Disposed in aperture 20 is a close-off fitting base 22. Close-off fitting base 22 includes a circular flange 24 which rests on an outer surface 26 of inner tank 14. Close-off fitting base 22 is made of a suitable material (typically metal) so that flange 24 is permanently attached to inner tank 14 by a suitable flange attaching means such as a continuous weld 28. Weld 28 also serves as a sealing means around flange 24. Above flange 24, close-off fitting base 22 includes an exteriorly threaded upper portion 30. Centrally of close-off fitting base 22, an interiorly threaded aperture is provided.

Figure 3:
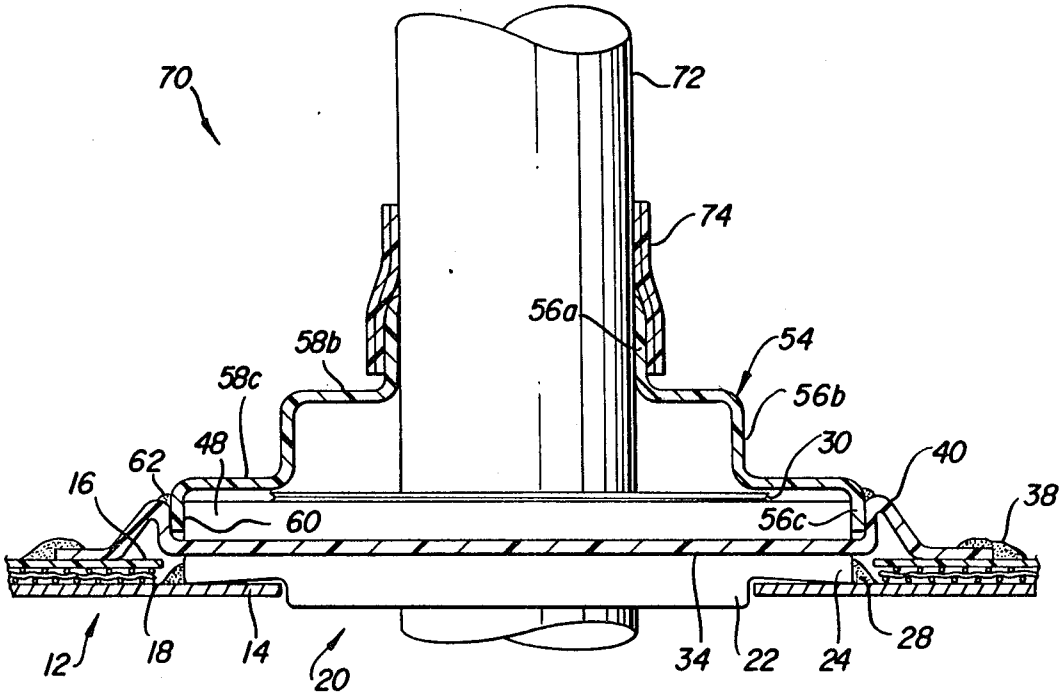
FIG. 3 is an elevation view in partial cross-section of another alternative embodiment of the multi-purpose fitting system according to the present invention.
Figure 5:
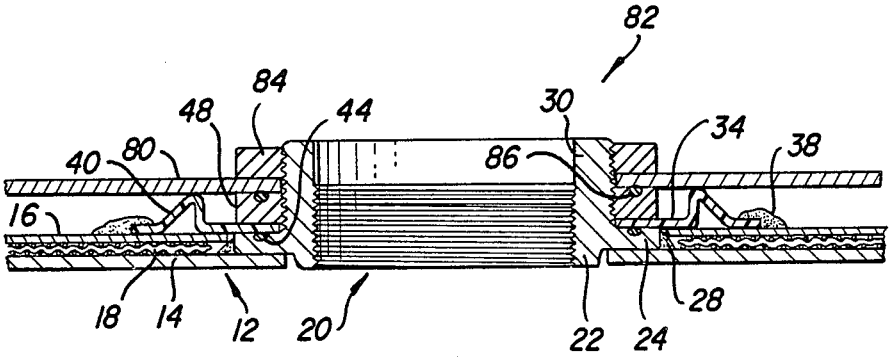
FIG. 5 is a cross-sectional elevation view of still another alternative embodiment of the multi-purpose fitting system according to the present invention.

Disposed on flange 24 is a close-off skirt 34. As shown, close-off skirt 34 extends outwardly from flange 34 and also rests on top of an outer surface 36 of outer tank 16. Close-off skirt 34 is preferably made of a plastics material such as the same material as outer tank 16, so that close-off skirt 34 is securely attached to outer surface 36 by a suitable attaching means such as a continuous weld 38. In this form, weld 38 also serves as a suitable sealing means between outer surface 36 and close-off skirt 34. Close-off skirt 34 also includes an upstanding rib 40 which is suitably U-shaped or right angle shaped as shown in FIGS. 3 and 5. If desired, a plurality of drain ports 42 adjacent rib 40 can also be provided as necessary.

A holding means in the form of an O-ring 44 is provided between flange 24 and close-off skirt 34. O-ring 44 is preferably disposed in a suitable groove 46 provided in flange 34 as shown.

Threadably received on upper portion 30 of close-off fitting base 22 is a close-off ring 48. As shown, close-off ring 48 has an edge 50 which is disposed adjacent, but spaced from, rib 40 of close-off skirt 34. Close-off ring 48 includes suitable tool engaging cavities (not shown) on the upper surface thereof for tightening close-off ring 48 against close-off skirt 34 to hold close-off skirt 34 securely against flange 24 and to compress O-ring 44. The compression of O-ring 44 acts to hold close-off ring 48 in place by increasing the frictional engagement between close-off ring 48 and close-off skirt 34.

In this embodiment of multi-purpose fitting system 10, access to container 12 through aperture 20 is not currently desired. Therefore, a plug 52 is threadably received in interior threaded aperture 32 of close-off fitting base 22. Plug 52 prevents the liquid in container 12 from passing through interior threaded aperture 32. Seal plug 52, close-off fitting base 22, and close-off ring 48 are then sealed from the outside environment by a close-off cap 54. Close-off cap 54 is preferably made of the same material as outer tank 16 and close-off skirt 34. In this preferred embodimet, close-off cap 54 is formed of three stepped rings including three rings **56*a*, 56*b*, and 56*c* and corresponding steps 58*a*, 58*b*, and 58*c*. Ring 56*c* forms a rim 60 which is snuggly received between edge 50 of flange 24 and rib 40 of close-off skirt 34. A suitable cap sealing means is provided such as a continuous weld 62 to seal close-off cap 54 to close-off skirt 34**.

With multi-purpose fitting system 10, it should be appreciated that an aperture 20 is provided in container 12 which is accessible through close-off cap 54. In the meantime, aperture 20 is closed by plug 52 to prevent leakage through close-off fitting base 22. In addition, close-off cap 54 and close-off skirt 34 provide a water-tight plastic covering over aperture 20.

Figure 2:
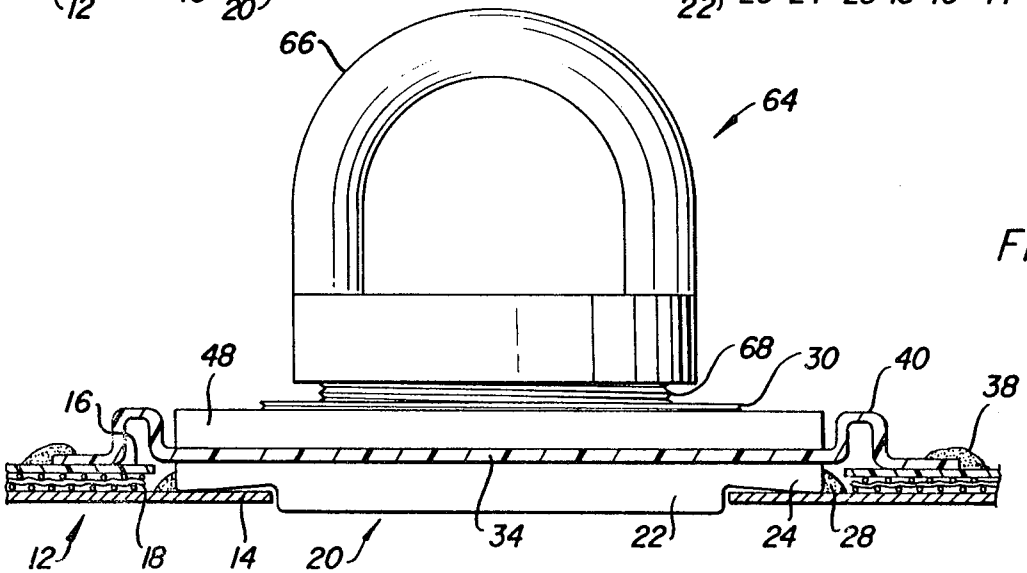
FIG. 2 is an elevation view in partial cross-section of an alternative embodiment of a multi-purpose fitting system according to the present invention.

Depicted in FIG. 2 is a multi-purpose fitting system 64 which is broadly similar to multi-purpose fitting system 10. Thus, in multi-purpose fitting system 64, elements which are the same as the elements in multi-purpose fitting system 10 have been identified with the same numerals.

As shown, multi-purpose fitting system 64 is basically the same as multi-purpose fitting system 10. However, in place of plug 52, multi-purpose fitting system 64 includes a steel hook 66 having a threaded portion 68 received in interior threaded aperture 32 of close-off fitting base 22.

Steel hook 66 is used to lift container 12 in place by the use of a suitable crane or the like. Thus, multi-purpose fitting system 66 does not include a close-off cap, as such a cap would prevent access to steel hook 66. It should be appreciated that weld 28 must be sufficiently strong to attach close-off fitting base 22 to inner tank 14 so that steel hook 66 and close-off fitting base 22 can be used to lift container 12.

It should also be appreciated that after steel hook 66 is used to move container 12 into place, steel hook 66 will no longer serve any purpose and is in fact undesired because close-off fitting base 22 and close-off ring 48 would be exposed to the outside environment and in particular to water damage or the like. Thus, steel hook 66 is simply unscrewed from close-off fitting base 22. Then, a suitable plug 52 is inserted in place of steel hook 66 and a close-off cap 54 positioned between flange 24 and rib 40 and welded in place. When this is accomplished, multi-purpose fitting system 64 has thus been transformed to a multi-purpose fitting system 10.

Figure 4:
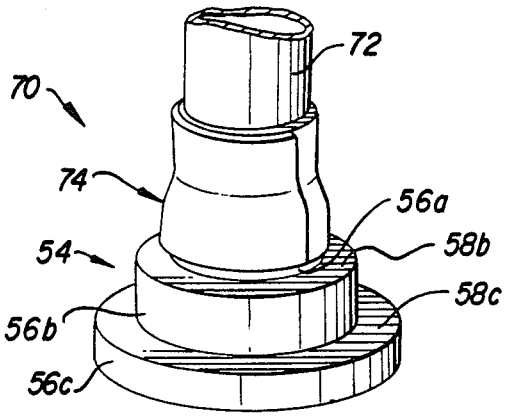
FIG. 4 is a perspective view of the close-off cap and pipe depicted in FIG. 3.

Depicted in FIGS. 3 and 4 is a multi-purpose fitting system 70. Multi-purpose fitting system 70 is also basically similar to multi-purpose fitting system 10 so that like elements have been identified with like numerals. Multi-purpose fitting system 70 is designed to provide access to container 12 by a pipe 72 through aperture 20. In order to accomplish this, a suitable step of close-off cap 54 is removed, such as step **58*a* as depicted in FIG. 1. This leaves ring 56*a* closely adjacent pipe 72. Then, in order to provide a seal between ring 56*a* and pipe 72, a suitable pipe sealing means in the form of a heat shrink plastic member is provided around pipe 72 and ring 56*a*. It should be appreciated that a suitable fitting (not shown) for pipe 72 is threadably received in interior threaded aperture 32 of close-off fitting base 22**.

In providing multi-purpose fitting system 70, it should be appreciated that both multi-purpose fitting system 10 and multi-purpose fitting system 64 are readily transformed to this configuration. Thus, after multi-purpose fitting system 64 has been used to place container 12 in position, steel hook 66 is simply removed and pipe 72 positioned in interior threaded aperture 32 of close-off fitting base 22. Close-off cap 54 is then suitably cut to remove step 58*a* and positioned around pipe 72. Weld 62 is then made around close-off cap 54 and heat shrink plastic member 74 applied around pipe 72.

Alternatively, if access is desired to container 12 through aperture 20 after plug 52 has already been provided, step 58*a* of close-off cap 54 is simply removed from close-off cap 54 of multi-purpose fitting system 10. Plug 52 is then withdrawn from interior threaded aperture 32 through the opening provided by the removal of step 58*a*. Next, pipe 72 and the associated fitting is inserted through close-off cap 54 into interior threaded aperture 32 and appropriately positioned. Finally, heat shrink plastic member 74 is applied about pipe 72 to complete installation.

If desired, upper portion 30 can be extended to accommodate a sump/riser base 80 as depicted in a multi-purpose fitting system 82 shown in FIG. 5. With this construction, a top ring 84 is also necessary, as well as an O-ring 86.

It should be appreciated that the multi-purpose fitting system described are designed to be appropriately transformed from one system to another as the needs of the user dictate.

It should also be appreciated that any one or more of the described multi-purpose fitting systems are simply supplied at the factory in a container 12. Then, after shipping, the user can transform any of the systems appropriately. In addition, even some time after installation, the various supplied systems can still be reconfigured by the user as desired, such as to provide a connection with another container, to provide access for an indicator or sensor, or to provide a connection to pump liquids therefrom.

It should further be appreciated that the multi-purpose fitting system of the present invention are designed for various standard elements, such as 4" steel NPT plugs or 2" pipes.

Thus, while the present invention has been described with respect to exemplary embodiments thereof, it will be understood by those of ordinary skill in the art that variations and modifications can be effected within the scope and spirit of the invention.

I claim:

1. A multi-purpose fitting system comprising:

a container including (a) an inner tank, (b) an outer tank surrounding said inner tank made of a plastics material, and (c) an aperture at a top of said container through said outer tank and said inner tank; and a multi-purpose fitting for said container aperture including (a) a close-off fitting base having an interior threaded aperture, an exterior threaded upper portion, and a flange located below said exterior threaded upper portion, (b) a flange attaching means for permanently attaching said flange of said close-off fitting base to an outer surface of said inner tank about said container aperture such that said exterior threaded upper portion extends above said outer tank and for providing a seal between said flange and the outer surface of said inner tank, (c) a close-off skirt made of a plastics material which rests on said flange and which extends beyond said flange to additionally rest on said outer tank, (d) a skirt attaching means for attaching said skirt securely to an outer surface of said outer tank and for providing a seal between said skirt and said outer surface of said outer tank, (e) a close-off ring which is threadably received on said threaded upper portion of said close-off fitting base to press said skirt against said flange, and (f) a fitting member threadably received in said interior threaded aperture of said close-off fitting base.

2. A multi-purpose fitting system as claimed in claim 1 and further including a holding means for increasing the frictional holding between said close-off ring and said close-off skirt.

3. A multi-purpose fitting system as claimed in claim 2 wherein said holding means in an O-ring disposed between said close-off skirt and said flange.

4. A multi-purpose fitting system as claimed in claim 1 and further including a close-off cap covering said close-off ring, and a cap sealing means for providing a seal between said close-off cap and said close-off skirt.

5. A multi-purpose fitting system as claimed in claim 4 wherein said skirt includes a raised circumferential rib about and adjacent said close-off ring, and wherein said close-off cap includes a depending rim which fits snuggly between said close-off ring and said raised rib.

6. A multi-purpose fitting system as claimed in claim 5 wherein said cap sealing means is a weld between said rib of said close-off skirt and said rim of said close-off cap, and wherein said skirt attaching means is a weld between said skirt and said outer tank.

7. A multi-purpose fitting system as claimed in claim 6 wherein said flange attaching means is a weld between said flange and said inner tank.

8. A multi-purpose fitting system as claimed in claim 4 wherein said fitting member is a plug.

9. A multi-purpose fitting system as claimed in claim 4 wherein said close-off cap is formed by a plurality of stepped rings.

10. A multi-purpose fitting system as claimed in claim 9 wherein said close-off cap is designed to be cut at said stepped rings to form an opening concentric with said interior threaded aperture of said close-off fitting base; wherein said fitting member includes a pipe extending through said opening and closely adjacent said cap; and further including a pipe sealing means for providing a seal between said pipe and said cap.

11. A multi-purpose fitting system as claimed in claim 10 wherein said pipe sealing means is a wrap-around heat shrink plastic member.

12. A multi-purpose fitting system as claimed in claim 1 and further including a stand-off mesh between said inner tank and said outer tank, and a drain port in said skirt between said cap sealing means and said close-off ring.

13. A multi-purpose fitting system as claimed in claim 1 wherein said fitting member includes a hook portion by which said container may be lifted.

* * * * *